US008130160B2

(12) United States Patent
Burns et al.

(10) Patent No.: US 8,130,160 B2
(45) Date of Patent: Mar. 6, 2012

(54) COMPOSITE DIPOLE ARRAY ASSEMBLY

(75) Inventors: Richard H. Burns, North Hollywood, CA (US); Sandor Holly, Woodland Hills, CA (US); Nicholas Koumvakalis, Thousand Oaks, CA (US)

(73) Assignee: The Boeing Company, Chicago, IL (US)

( * ) Notice: Subject to any disclaimer, the term of this patent is extended or adjusted under 35 U.S.C. 154(b) by 395 days.

(21) Appl. No.: 12/264,152

(22) Filed: Nov. 3, 2008

(65) Prior Publication Data

US 2010/0001915 A1 Jan. 7, 2010

Related U.S. Application Data

(60) Provisional application No. 61/078,044, filed on Jul. 3, 2008.

(51) Int. Cl.
*H01Q 19/10* (2006.01)

(52) U.S. Cl. ..... 343/755; 343/703

(58) Field of Classification Search ..... 343/755, 343/703, 722, 729, 751, 753, 781 CA, 783, 343/809

See application file for complete search history.

(56) References Cited

U.S. PATENT DOCUMENTS

| | | | | |
|---|---|---|---|---|
| 2,632,058 A | | 11/1947 | Gray | |
| 3,348,093 A | | 10/1967 | Holly | |
| 3,705,956 A | | 12/1972 | Dertouzos | |
| 3,755,815 A | * | 8/1973 | Stangel et al. | 342/371 |
| 3,852,755 A | | 12/1974 | Works et al. | |
| 3,919,638 A | | 11/1975 | Belden, Jr. | |
| 4,264,814 A | | 4/1981 | Freund et al. | |
| 4,600,559 A | | 7/1986 | Hiatt | |
| 4,634,968 A | | 1/1987 | Aslan | |
| 4,638,813 A | | 1/1987 | Turner | |
| 4,806,747 A | | 2/1989 | Dunavan et al. | |
| 4,942,291 A | | 7/1990 | Dietrich | |
| 5,030,962 A | | 7/1991 | Rees | |
| 5,103,083 A | | 4/1992 | Reed et al. | |
| 5,148,182 A | * | 9/1992 | Gautier et al. | 343/754 |
| 5,154,973 A | * | 10/1992 | Imagawa et al. | 428/325 |
| 5,233,263 A | | 8/1993 | Cronin et al. | |
| 5,308,439 A | | 5/1994 | Cronin et al. | |
| 5,420,595 A | | 5/1995 | Zhang et al. | |
| 5,483,060 A | | 1/1996 | Sugiura et al. | |
| 5,756,999 A | | 5/1998 | Parrish et al. | |

(Continued)

FOREIGN PATENT DOCUMENTS

GB 2121612 A 12/1983

(Continued)

OTHER PUBLICATIONS

U.S. Appl. No. 12/022,891, filed Jan. 30, 2008, Sandor Holly et al.

(Continued)

*Primary Examiner* — Jacob Y Choi
*Assistant Examiner* — Shawn Buchanan
(74) *Attorney, Agent, or Firm* — Haynes and Boone, LLP

(57) ABSTRACT

A composite dipole array assembly can have a composite dipole array defined by a plurality of antenna elements and a plurality of non-linear element electrically interconnecting pair of the antenna elements. A reflector can be configured to reflect electromagnetic energy toward the antenna elements. A lens can be configured to focus electromagnetic energy upon the antenna elements. In this manner, the efficiency of the composite dipole array is enhanced.

10 Claims, 3 Drawing Sheets

U.S. PATENT DOCUMENTS

| | | | | |
|---|---|---|---|---|
| 5,771,022 | A * | 6/1998 | Vaughan et al. | 343/702 |
| 5,825,029 | A * | 10/1998 | Agnese et al. | 250/338.1 |
| 5,856,803 | A | 1/1999 | Pevler | |
| 5,939,721 | A | 8/1999 | Jacobsen et al. | |
| 6,014,110 | A * | 1/2000 | Bridges | 343/783 |
| 6,492,957 | B2 | 12/2002 | Carillo, Jr. et al. | |
| 6,518,932 | B1 * | 2/2003 | Matsui et al. | 343/770 |
| 6,605,808 | B2 | 8/2003 | Michan et al. | |
| 6,864,825 | B2 | 3/2005 | Holly | |
| 6,943,742 | B2 * | 9/2005 | Holly | 343/753 |
| 6,944,486 | B2 | 9/2005 | Braig et al. | |
| 6,950,076 | B2 | 9/2005 | Holly | |
| 6,999,041 | B2 | 2/2006 | Holly | |
| 7,009,575 | B2 * | 3/2006 | Holly et al. | 343/820 |
| 7,122,813 | B2 | 10/2006 | Linfield et al. | |
| 7,142,147 | B2 | 11/2006 | Holly | |
| 7,265,331 | B2 | 9/2007 | Holly et al. | |
| 7,473,898 | B2 | 1/2009 | Holly et al. | |
| 7,683,844 | B2 * | 3/2010 | Alamouti et al. | 343/754 |
| 2002/0075189 | A1 | 6/2002 | Carillo, Jr. et al. | |
| 2004/0008149 | A1 | 1/2004 | Killen et al. | |
| 2004/0252065 | A1 * | 12/2004 | Agnese et al. | 343/703 |
| 2005/0088358 | A1 | 4/2005 | Larry et al. | |
| 2006/0202123 | A1 | 9/2006 | Villermoz et al. | |
| 2008/0017813 | A1 | 1/2008 | Holly et al. | |
| 2008/0169994 | A1 * | 7/2008 | Hasegawa | 343/834 |
| 2008/0291108 | A1 | 11/2008 | Holly et al. | |

FOREIGN PATENT DOCUMENTS

| | | | |
|---|---|---|---|
| JP | 01101006 | | 4/1989 |
| JP | 2006-211637 | | 8/2006 |
| WO | 03/019738 | A1 | 3/2003 |
| WO | 2005/093904 | A1 | 10/2005 |
| WO | 2006/088802 | A2 | 8/2006 |

OTHER PUBLICATIONS

U.S. Appl. No. 12/264,153, filed Nov. 3, 2008, Sandor Holly et al.
U.S. Appl. No. 12/264,128, Nov. 3, 2008, Sandor Holly et al.
PCT/US2006/005057; Feb. 14, 2006; The Boeing Company.
PCT/US2008/061106; Apr. 22, 2008; The Boeing Company.
Maier, W.B., Freund, S. M., Holland, R.F. & Beattie, Photolytic separation of D from H. in cryogenic solutions of formaldehyde 69, 1961 (1978).
J. T. Kindt and C. A. Schmuttenmaer. Far-infrared dielectric properties of polar liquids probed by femtosecond THz pulse spectroscopy. Journal of Physical Chemistry, 100:10373-10379, 1996.
Park et al., A Novel lateral field emitter triode with Insitu vacuum encapulation, international electron devices meeting, 1996.
Park et al., Lateral field emission diodes using SIMOX wafer, IEEE transactions on electron devices, vol. 44, No. 6, Jun. 1997.
Milanovic et al., Micromachining Technology for Lateral Field Emission Devices, IEEE Transactions on Electron Devices, vol. 48, No. 1, Jan. 2001.
Peter H. Siegel, Terahertz Technology, IEEE Transactions on Microwave Theory and Techniques, Mar. 2002, pp. 910-928, vol. 50, No. 3.
Peter H. Siegel, THz Technology; An Overview, International Journal of High Speed Electronics and Systems, 2003, pp. 1-44, vol. 13, No. 2, World Scientific Publishing Company, USA.
Raman et al., A W-Band Dielectric-Lens-Based Integrated Monopulse Radar Receiver, IEEE Transactions on Microwave Theory and Techniques, Dec. 1998, pp. 2308-2316, vol. 46, No. 12.
Filipovic et al., Off-Axis Properties of Silicon and Quartez dielectric lens Antennas, IEEE Transcations on Antennas and Progagation, May 1997, pp. 760-766, vol. 45, No. 5.

* cited by examiner

COMPOSITE DIPOLE ARRAY ASSEMBLY

PRIORITY CLAIM

This patent application claims the benefit of the priority date of U.S. provisional patent application Ser. No. 61/078,044, filed on Jul. 3, 2008 and entitled Composite Dipole Array Assembly pursuant to 35 USC 119. The entire contents of this provisional patent application are hereby expressly incorporated by reference.

TECHNICAL FIELD

The present invention relates generally to radio frequency antennas and, more particularly, to a composite dipole array (CDA) assembly having a reflector and a lens to enhance the efficiency thereof.

BACKGROUND

Composite dipole arrays are known. A composite dipole array can contain a string of alternating resonant circuits whose function is to receive electromagnetic radiation at two different frequencies and then re-radiate a single signal at the difference frequency. Re-radiation at the difference frequency is facilitated by non-linear device elements of the composite dipole array.

For example, such composite dipole arrays can covert energy from a pair of higher frequency microwave signals into a lower frequency signal at the difference frequency of the two higher frequency signals.

Composite dipole arrays can provide frequency conversion for a variety of applications such as remote sensing, short range covert communications, compact radar ranging systems, inter-satellite communication links, testing of integrated circuits, and even medical imaging and treatment. In the field of medical imaging, for example, tumors and other pathologies can be identified and characterized.

Examples of composite dipole arrays structures are described in U.S. Pat. No. 6,999,041, entitled Dual Frequency Antennas And Associated Down-Conversion Method, issued Feb. 14, 2006, and in U.S. Pat. No. 7,009,575 entitled High-Frequency Two-Dimensional Antenna and Associated Down-Conversion Method, issued on Mar. 7, 2006, the entire contents of both of which are expressly incorporated herein by reference in their entirety.

However, the ability of a contemporary composite dipole array receiver to detect incident electromagnetic radiation is limited by the power of the incident signal, the sensitivity of the receiver, and the gain of the antenna. Of course, the range of a composite dipole array receiver is dependent upon its ability to detect incident electromagnetic radiation.

In some instances, the ability to detect incident electromagnet radiation can be improved by increasing transmitted power, but this is not always possible. Increasing the transmitted power can raise cost and safety issues. In some applications, transmitted power may not be under the control of the user.

Additionally, the ability to detect incident electromagnet radiation can be improved by increasing receiver sensitivity. However, when a low noise receiver is being used, little improvement is generally available in the area of receiver sensitivity.

As a result, there is a need for increasing the gain of a contemporary composite dipole array antenna so as to enhance a receiver's ability detect incident electromagnetic radiation and thus to enhance the range of the receiver.

SUMMARY

Systems and methods are disclosed herein to provide more efficient composite dipole array (CDA) antennas. For example, in accordance with an example of an embodiment, electromagnetic radiation that otherwise would not be picked up by the composite dipole array is directed toward the composite dipole array such that it is picked up thereby.

More specifically, in accordance with an example of an embodiment, a composite dipole array assembly can comprise a composite dipole array and a reflector. The reflector can be configured to enhance the efficiency of the composite dipole array.

In accordance with an example of an embodiment, a composite dipole array assembly can comprise a plurality of antenna elements, a plurality of non-linear elements electrically interconnecting pairs of the antenna elements, and a reflector. The reflector can be configured to reflect electromagnetic energy toward the antenna elements.

In accordance with an example of an embodiment, a composite dipole array assembly can comprise a composite dipole array and a lens. The lens can be configured to enhance the efficiency of the composite dipole array.

In accordance with an example of an embodiment, a composite dipole array assembly can comprise a plurality of antenna elements, a plurality of non-linear element electrically interconnecting pair of the antenna elements, and a lens. The lens can be configured to focus electromagnetic energy upon the antenna elements.

In accordance with an example of an embodiment, a composite dipole array assembly can comprise a plurality of antenna elements, a plurality of non-linear elements electrically interconnecting pair of the antenna elements, a reflector and a lens. The reflector can be configured to reflect electromagnetic energy toward the antenna elements. The lens can be configured to focus electromagnetic energy upon the antenna elements.

In accordance with an example of an embodiment, a method for enhancing the sensitivity of a composite dipole array can comprise reflecting electromagnetic radiation toward the composite dipole array. For example, a reflector can be positioned behind the composite dipole array to reflect electromagnet radiation that was not absorbed by the composite dipole array. This electromagnet radiation can be reflected back toward the composite dipole array.

In accordance with an example of an embodiment, a method for enhancing the sensitivity of a composite dipole array can comprise focusing electromagnetic radiation upon the composite dipole array. For example, a lens can be positioned in front of the composite dipole array to focus electromagnet radiation that otherwise would not be absorbed by the composite dipole array. This electromagnetic radiation can be focused upon the composite dipole array.

In accordance with an example of an embodiment, a method for enhancing the sensitivity of a composite dipole array can comprise both reflecting electromagnetic radiation toward the composite dipole array and focusing electromagnetic radiation upon the composite dipole array.

Enhancing the efficiency of a composite dipole array increases the range thereof. Thus, the variety of different applications of the composite dipole array can be increased and the effectives of the composite dipole array can be increased.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

As described in U.S. Pat. No. 7,009,575, a composite dipole array can be defined as an array of microwave diodes that, when irradiated with two different frequencies of microwave radiation, generate a third frequency. The third frequency is the difference between the first two frequencies.

The composite dipole array can be a structure having many modules where each module comprises two antenna elements that are electrically interconnected by a non-linear device, such as a diode. The individual modules resonant at the input frequencies. The overall structure resonates at the difference frequency.

Two different embodiments for enhancing the conversion efficiency of a composite dipole array are disclosed. One embodiment comprises using a reflector to direct electromagnetic energy (that would otherwise miss the antenna elements) toward the antenna elements. The other embodiment comprises using a lens to focus electromagnetic energy (that would otherwise miss the antenna elements) upon the antenna elements.

The two embodiments can be used separately or in combination with one another. Each of these embodiments substantially enhances the conversion efficiency of a composite dipole array such that a greater amount of difference frequency is re-radiated for a given power density of the two higher frequency inputs.

More particularly, according to these two embodiments a greater amount of the input frequencies can be absorbed by the composite dipole array and a greater amount of the difference frequency can be re-radiated in a desired direction.

Reflector Embodiment

Figure 1:
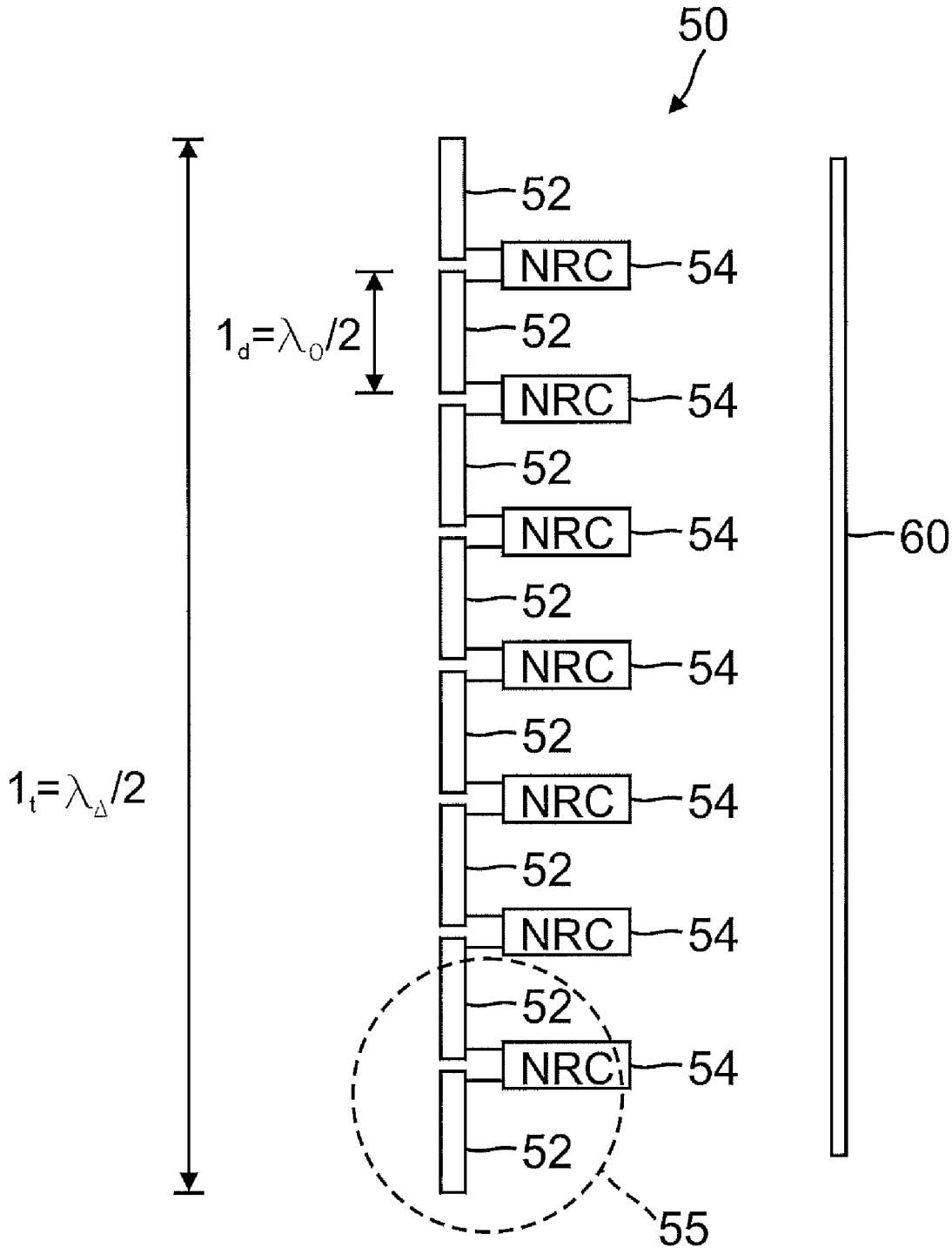
FIG. 1 is a block diagram showing a composite dipole array assembly having a reflector, in accordance with an example of an embodiment.

Referring now to FIG. 1, an example of an embodiment can comprise a composite dipole array 50 that comprises a plurality of antenna elements 52 that are electrically interconnected with a plurality of non-linear circuits 54. The antenna elements 52 can comprise lengths of conductor. The lengths of conductor can define a plurality of dipoles that are physically separated from one another by a short distance and electrically connected to one another by the non-linear circuits 54. The conductor can comprise a film or coating that is applied to a non-conductive substrate, such as spacer 61 of FIG. 2.

An example of a module 55 can comprise two antenna elements 51 and one non-linear circuit 54. The composite dipole array 50 can contain a plurality of such modules 55.

The composite dipole array 50 can be a one dimensional array of antenna elements 52 and non-linear circuits 54. Alternatively, the composite dipole array 50 can be a two or three dimensional array of antenna elements 52 and non-linear circuits.

If the antenna elements 52 are perfectly impedance matched to the non-linear circuits 54 in the composite dipole array, then the composite dipole array will effectively capture all the incident radiation over an area of:

$$A_{EFF} = \frac{\lambda^2}{2\pi}.$$

wherein:

$A_{EFF}$ is the effective area of the composite dipole array; and $\lambda$ is the wavelength of incident electromagnetic radiation.

However, if the antenna elements 52 are not perfectly impedance matched to the non-linear circuits 54 in the composite dipole array (which is normally the case in practice), then much of the incident energy will pass on by the composite dipole array and be lost. The use of a reflector according to an example of an embodiment facilitates the re-capture of some of this otherwise lost energy.

According to an example of an embodiment, a conductive reflector is placed behind (on the opposite side from incident electromagnetic radiation) the composite dipole array such that the otherwise wasted energy can be made to pass again by the array. This configuration provides a potential for substantially increasing the energy captured by the composite dipole array 50.

Figure 2:
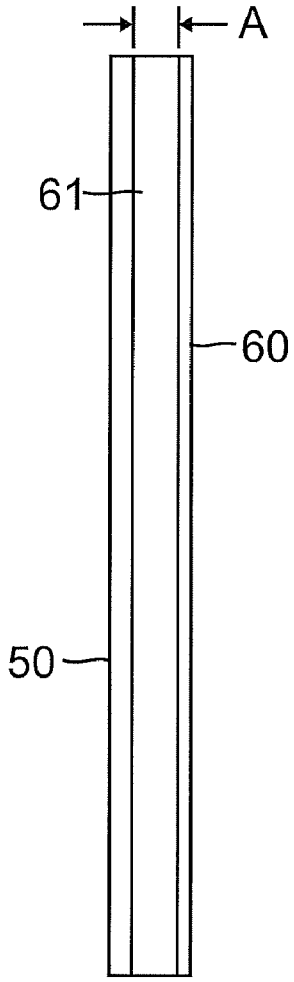
FIG. 2 is a cross-sectional side view of a composite dipole array assembly having a reflector, in accordance with an example of an embodiment.

Referring now to FIG. 2, the reflector can be spaced away from the array by a distance, Dimension A, using a substrate or spacer 61. The spacer 61 can be air, space (a vacuum), or any desired material that is at least partially transparent at the input frequencies and/or the difference frequency. The spacer 61 can comprise a dielectric material, such as glass or quartz.

Dimension A can be an electrically odd number of quarter wavelengths at the average wavelength of the two incident frequencies. Such configuration will position the array at an electrical antinode of the standing wave pattern set up at each frequency.

Since the two input frequencies are slightly different, the wavelengths of the standing wave patterns will be slightly different with respect to one another. This difference causes a node of one to align with an antinode of the other after traveling a distance of one quarter wavelength of the difference frequency. Thus, for the sake of efficient input coupling, it is desirable to make the spacing between array and reflector equal to (4N+1)/4 wavelengths of the average of the input frequencies, where N is a small integer, ideally zero.

The composite dipole array can be spaced away from the reflector based upon the difference frequency such that the composite dipole array radiates well at the difference frequency. A quarter wavelength at the difference frequency is a spacing where the two input waves beat destructively.

The distance, Dimension A, between the composite dipole array 50 and the reflector 60 can be optimized for reception of the input frequencies, can be optimized for re-radiation of the difference frequency, and/or can be a compromise between optimization of the input frequencies and optimization for the re-radiated difference frequency.

The dielectric constant of the material 61 between the composite dipole array 50 and the reflector 60 at the input and different frequencies can be varied. Varying the dielectric constant of this material, and the allowed angular distribution of the input and difference frequencies.

Figure 3:
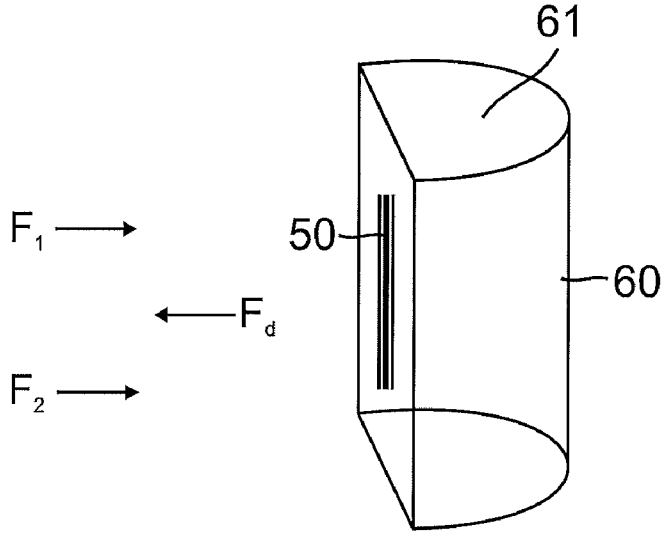
FIG. 3 is semi-schematic perspective view showing a composite dipole array assembly having a reflector disposed behind a composite dipole array thereof, in accordance with an example of an embodiment.

Referring now to FIG. 3, the reflector 60 can comprise a concave half cylinder. That is, the reflector 60 can have a cross-section that generally defines a semi-circle or the like. The reflector 60 can have a cross-section that generally defines a parabola or the like. The composite dipole array 50 can be positioned on an axis of the half cylinder.

Two different input frequencies $F_1$ and $F_2$ are shown being directed toward the composite dipole array 50. The difference frequency $F_d$ is shown being re-radiated from the composite dipole array 50.

Figure 4:
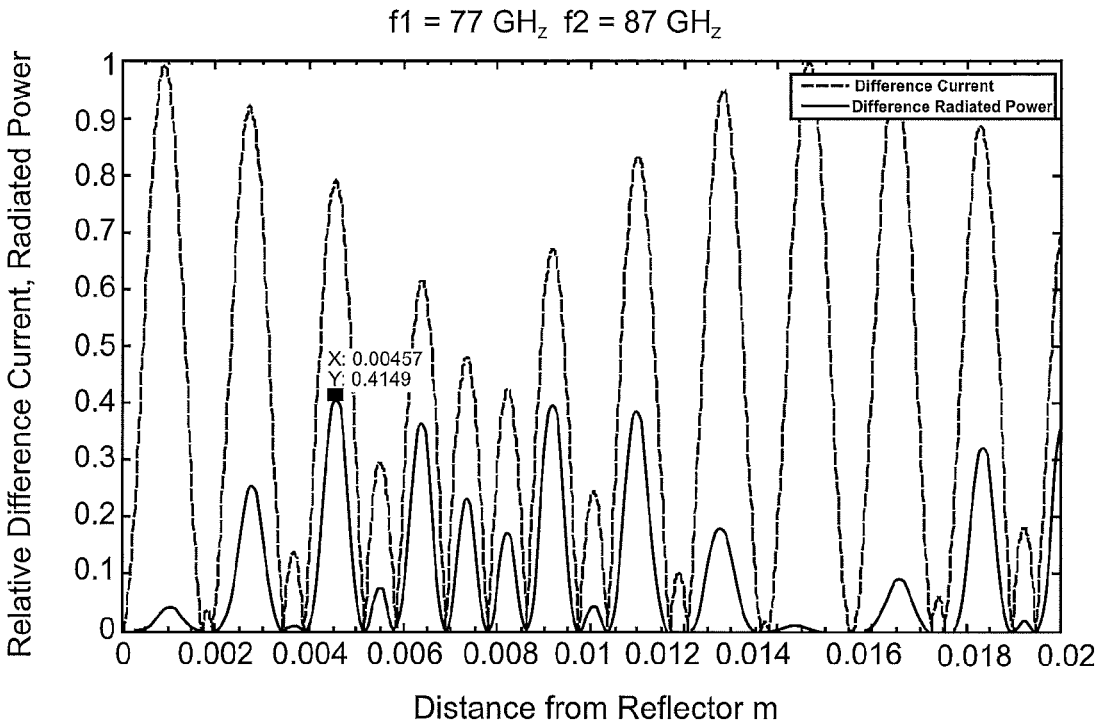
FIG. 4 is a chart showing the relative response for a square law composite array, such as that of FIG. 1, at normal incidence and re-radiation with unity dielectric constant between the composite dipole array and the reflector, in accordance with an example of an embodiment.

Referring now to FIG. 4, a chart shows the relative response for a square law composite dipole array at normal incidence and for re-radiation. A material, e.g., spacer 61, having unity dielectric constant is disposed between the composite dipole array 50 and the reflector 60. In this instance, input frequency f1=77 GHz and input frequency f2=87 GHz.

This chart graphically shows the relative effects of the conflicting spacing requirements for the input frequencies and the re-radiate difference frequency. For this particular set of conditions, a spacing of 4.57 mm gives good re-radiation (red curve) at the difference frequency.

The use of such a reflector is expected to provide, at least in some instances, approximate a 10 dB (10× power) improvement with respect to a composite dipole array that lacks such a reflector.

Lens

Figure 5:
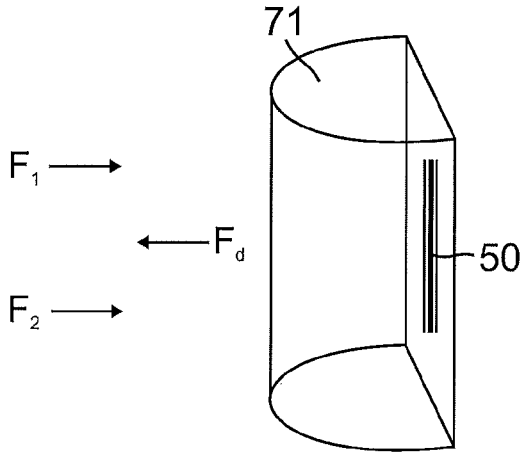
FIG. 5 is semi-schematic perspective view showing a composite dipole array assembly having a lens disposed in front of a composite dipole array thereof, in accordance with an example of an embodiment.

Referring now to FIG. 5, according to an example of an embodiment the effective capture area of the composite dipole array 50 can be increased by focusing electromagnetic energy, i.e., the two input frequencies, upon the composite dipole array 50. For example, a small half-cylindrical lens 71 can be positioned in front of the composite dipole array 50.

The lens 71 can comprise a concave half cylinder. That is, the lens 71 can have a cross-section that generally defines a semi-circle or the like. The lens 71 can have a cross-section that generally defines a parabola or the like. The composite dipole array 50 can be positioned on an axis of the half cylinder.

Two different input frequencies $F_1$ and $F_2$ are shown being directed toward the composite dipole array 50. The difference frequency $F_d$ is shown being re-radiated from the composite dipole array 50.

In the limit of high dielectric constant, and therefore high index, the focal length of the lens is the radius r. The resultant linear spot size is on order of:

$$\frac{2\lambda F}{D} = \frac{2\lambda r}{2r} = \lambda$$

where λ is the wavelength of the incident millimeter wave radiation;

F is the focal length of the lens;

D is the distance between the lens and the lens and the composite dipole array; and r is the radius of curvature of the lens.

The concentration factor is approximately r/λ. If r=12 mm, and λ=3 mm, this would be a factor of 4. This concentration is obtained at the expense of field of view (FOV). From thin lens theory, with air between lens and image, the FOV would be equal to $\tan^{-1}(\lambda/r)$. Again, for r=12 mm, and λ=3 mm, this evaluates to slightly less than 0.25 radian, or 15 degrees. In this case, however, the space between the lens surface and the image is filled with a high index material so that $$FOV=\tan^{-1}(n\lambda/r)=\tan^{-1}(\sqrt{k}\lambda/r)$$

Where n is the index in the material which has a dielectric constant of k.

If k=25 at the operating frequency, n=5 and the FOV in the above case is now 0.9 radians, or 53 degrees.

The benefit of high dielectric constant in the lens must be traded against the Fresnel losses introduced at the lens surface. An antireflection coating will help mitigate these losses.

Combination of Reflector and Lens

The above examples of embodiments are not mutually exclusive. The reflector and the lens can be used together so as to better enhance the returned signal, i.e., the difference frequency. For example, the lens can be combined with the reflector by making the reflector a concave half cylinder with the composite on the axis. This achieves both functions without the Fresnel losses that are introduced at the surface of a high dielectric constant lens.

For example, the half cylinder reflector 60 of FIG. 3 can be combined with the half cylinder lens 71 of FIG. 5. In this manner, a complete cylinder having the composite dipole array 50 dispose along the axis thereof is defined.

More than one reflector can be used for a given composite dipole array. For example, larger reflectors can be place behind smaller reflectors. As a further example, additional reflectors can be positioned beside the above discussed reflector. Similarly, more than one lens can be used.

Embodiments described above illustrate but do not limit the invention. It should also be understood that numerous modifications and variations are possible in accordance with the principles of the present invention. Accordingly, the scope of the invention is defined only by the following claims.

We claim:

1. A composite dipole array assembly comprising:

a plurality of antenna elements disposed in a one-dimensional linear array;

a plurality of passive non-linear elements respectively interconnecting pairs of the antenna elements electrically so as to define a composite dipole linear array operable to receive two signals having respective first and second frequencies incident upon a front surface thereof and to passively generate and radiate away from the front surface a third signal having a frequency equal to the difference between the first and second frequencies; and a semicircular or a parabolic reflector disposed behind the array, the reflector having an elongated axis along which the array is disposed and being configured to reflect portions of the two incident signals that miss the array back to the array and focus them thereon.

2. The composite dipole array assembly as recited in claim 1, wherein the reflector comprises a metalized layer spaced away from the antenna elements and the non-linear elements.

3. The composite dipole array assembly as recited in claim 1, wherein the reflector is spaced away from the antenna elements and the non-linear elements by a distance that is an odd number of quarter wavelengths of an average of two incident frequencies.

4. The composite dipole array assembly as recited in claim 1, wherein the reflector is spaced away from the antenna elements and the non-linear elements by a distance that is one quarter wavelength of an average of two incident frequencies.

5. The composite dipole array assembly as recited in claim 1, wherein the reflector is spaced away from the antenna elements and the non-linear elements by a distance that is one quarter wavelength of a difference frequency.

6. A composite dipole array assembly comprising:

a plurality of antenna elements disposed in a one-dimensional linear array;

a plurality of passive non-linear elements respectively interconnecting pairs of the antenna elements electrically so as to define a composite dipole linear array operable to receive two signals having respective first and second frequencies incident upon a front surface thereof and to passively generate and radiate away from the front surface a third signal having a third frequency equal to the difference between the first and second frequencies; and a semicircular or a parabolic lens disposed in front of the array, the lens having an elongated axis along which the array is disposed and being configured to focus the two incident signals on the front surface of array.

7. The composite dipole array assembly as recited in claim 6, wherein the lens is formed of a material having a high dielectric constant.

8. The composite dipole array assembly as recited in claim 6, wherein the lens is formed of a material having a dielectric constant greater than 25.

9. The composite dipole array assembly as recited in claim 6, further comprising an anti-reflection coating formed upon the lens.

10. The composite dipole array assembly of claim 6, further comprising:

a semicircular or a parabolic reflector disposed behind the array, the reflector having an elongated axis along which the array is disposed and being configured to reflect portions of the two incident signals that miss the array back onto the array and focus them thereon.

* * * * *